US005215558A

United States Patent [19]

Moon

[11] Patent Number: 5,215,558

[45] Date of Patent: Jun. 1, 1993

[54] ELECTRICAL DUST COLLECTOR

[75] Inventor: Je-Myung Moon, Suwon, Rep. of Korea

[73] Assignee: Samsung Electronics Co., Ltd., Suweon, Rep. of Korea

[21] Appl. No.: 713,298

[22] Filed: Jun. 11, 1991

[30] Foreign Application Priority Data

Jun. 12, 1990 [KR] Rep. of Korea ..... 90-8629

[51] Int. Cl.[5] ..... B03C 3/36

[52] U.S. Cl. ..... 55/129; 55/138

[58] Field of Search ..... 55/129, 137, 138, 128, 55/130

[56] References Cited

U.S. PATENT DOCUMENTS

| | | | |
|---|---|---|---|
| 1,980,521 | 11/1934 | Hahn | 55/128 X |
| 2,221,467 | 11/1940 | Bleakney | 55/138 X |
| 2,798,572 | 7/1957 | Fields | 55/128 X |
| 2,871,974 | 2/1959 | Werst | 55/137 X |
| 3,016,980 | 1/1962 | Gonzalez | 55/137 |
| 3,149,937 | 9/1964 | Revell | 55/137 |
| 3,740,927 | 6/1973 | Vincent | 55/123 |
| 3,778,970 | 12/1973 | Swimmer et al. | 55/137 |
| 4,349,359 | 9/1982 | Fitch et al. | 55/138 X |

FOREIGN PATENT DOCUMENTS

| | | | |
|---|---|---|---|
| 8303208 | 9/1983 | PCT Int'l Appl. | 55/128 |
| 792068 | 3/1958 | United Kingdom | 55/128 |

*Primary Examiner*—Richard L. Chiesa

*Attorney, Agent, or Firm*—Burns, Doane, Swecker & Mathis

[57] ABSTRACT

An electric dust collector includes a plurality of alternately arranged collecting units and accelerating units forming air flow passages therebetween. Each accelerating unit has a hole therethrough, and a plurality of wires extending across the hole in a direction perpendicularly to the direction of the air flow. The accelerating units and wires are charged with the same polarity, and the collecting units are charged with an opposite polarity.

7 Claims, 5 Drawing Sheets

FIG. 3(a)
(PRIOR ART)
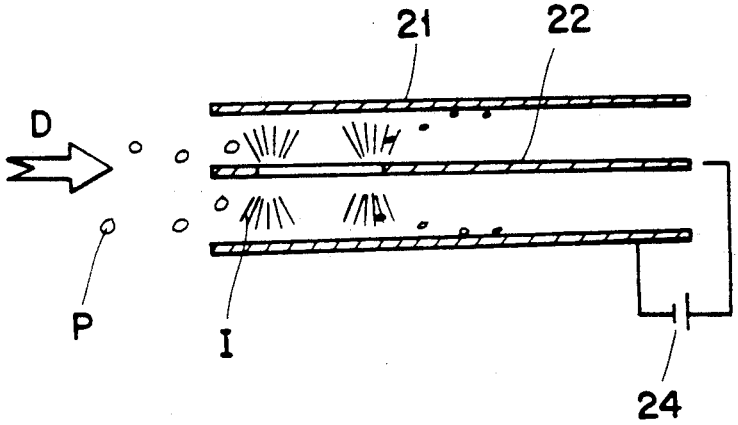
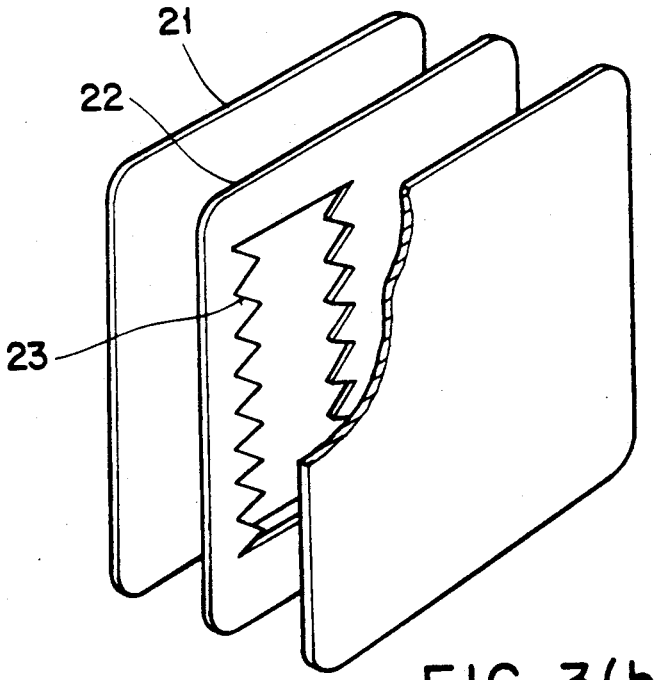
FIG. 3(b)

ELECTRICAL DUST COLLECTOR

BACKGROUND OF THE INVENTION

1. Field of the Invention

The present invention relates to an electrical dust collector for an air cleaner being capable of cleaning the indoor air.

2. Description of the Prior Art

An ion-wind or ion-field type air cleaner disclosed in Japanese patent laid-open publication No. sho 61-61656 is known conventionally as an electrical dust collector for an air cleaner. As shown in FIG. 1, this ion-wind type air cleaner comprises a plurality of ionizing electrodes 1, opposing dust collecting electrodes 2 and accelerating electrodes 3. An ion-field is produced between the ionizing electrodes 1 and the opposing dust collecting electrodes 2 and dust is collected between the dust collecting electrodes 2 and the accelerating electrodes 3. A, plurality of auxiliary electrodes 4 are disposed between a plurality of the ionizing electrodes 1 and a plurality of the opposing dust collecting electrodes 2, respectively. The auxiliary electrodes 4 are supplied with a voltage whose potential is less than the voltage supplied between the ionizing electrodes 1 and the dust collecting electrodes 2.

With the air cleaner constructed as described above, there is an advantage that the air cleaner can generate an intensive ion-field but there are problems in that the structure is complicated and the manufacturing cost is high.

Also, an electrostatic precipitator as shown in FIG. 2 and disclosed in U.S. Pat. No. 3,740,927, which comprises a first section 10 having a plurality of negatively charged vertical wires w arranged between at least one or more pairs of positively charged vertical plates P1–P3. A second section 20 has a plurality of metallic grids G21 to G26 attached to the respective vertical plates P1–P3. A corona discharge may be developed between the positively charged plates and the negatively charged wires. The metallic grids are placed against the end of the first section 10 and are parallel to each other. The first and last grids G21 and G26 are connected a source of voltage so as to prevent corona discharge, and the remaining grids G22 to G25 are floated between the grids 21 and 26 so as to become charged by voltage induced in such grids 21, 26.

With this structure, particles of matter entering the second section 20 and traversing the opening of various grids will respond to the electric field between adjacent grids and to the aerodynamic flow pattern developed between all of the grids. As a result, there is an advantage that dust may be collected and removed from fluid medium, but there are problems in that the electrostatic precipitator is complicated and the manufacturing cost is expensive, and that since the metallic grids are in a floating state the dust collecting efficiency is decreased.

Another electrical dust collector for an air cleaner is shown in FIGS. 3(*a*) and (*b*), and will be now described simply.

Referring to FIGS. 3(*a*) and (*b*), in the structure of the electrical dust collector, an accelerating unit 22 is disposed centrally within a dust collecting unit 21, and sharp teeth 23, similar to saw teeth, act as the ionizing unit for charging dust particles P. The teeth are formed in a predetermined portion of the accelerating unit 22. With this structure, if the d.c. power 24 is supplied, dust particles P in the air D introduced in the dust collector are charged by the teeth 23 and then collected on the dust collecting unit 21.

In this case, however, since dust particles P to be collected are collected non-uniformly over the surfaces of the dust collecting unit 21, a spark phenomenon will occur. In addition, when the d.c. power supply 24 is a high voltage, a flame discharge is caused between the sharp teeth 23 formed in the accelerating unit 22 and the dust collecting unit 21, and a great deal of harmful ozone will be produced. Further, the ionization is performed concentratedly only on the sharp teeth formed in the accelerating unit 22, causing a problem in that the collecting efficiency of the dust collecting unit 21 is decreased.

SUMMARY OF THE INVENTION

Accordingly, the present invention has been made in consideration of the aforementioned problems and an object of the present invention is to provide an electrical dust collector in which the electric field is formed uniformly to improve the entire dust collecting efficiency.

Another object of the present invention is to provide an electrical dust collector which obtains the maximum dust collecting efficiency without incurring a flame discharge even though high voltage is supplied.

Still another object of the present invention is to provide an electrical dust collector in which accelerating units and ionizing units are formed integrally and connected and removed freely in relation to dust collecting units in cleaning of the dust collector.

To achieve the aforementioned objects, the electrical dust collector according to the present invention comprising a power supply unit, ionizing units for charging dust particles containing in the air introduced, dust collecting units supplied the power supply from the power supply unit and for collecting dust particles charged by the ionizing units, and accelerating units energized by the power supply from the power supply unit and allowing to be collected effectively dust particles charged by the ionizing units onto the dust collecting units, characterized in that, the ionizing units are formed integrally with the accelerating units by arranging a plurality of ionizing wires into respective grooves formed on the partial area of the accelerating units, respectively.

BRIEF DESCRIPTION OF THE DRAWINGS

FIG. 3(*a*) is a plan view of an electrical dust collector for a conventional air cleaner;

FIG. 3(*b*) is a perspective view of FIG. 3(*a*);

FIG. 4(*b*) is a perpective view of FIG. 4(*a*); and,

DESCRIPTION OF THE PREFERRED EMBODIMENT

A preferred embodiment of the present invention will be now described in more detail with reference to the accompanying drawings.

Figure 1:
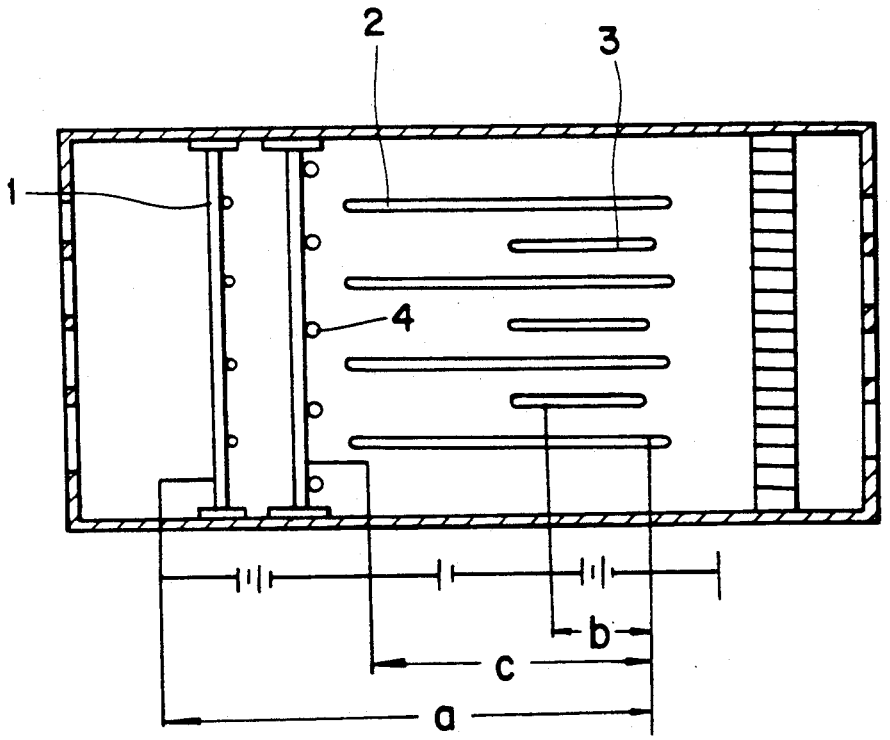
FIG. 1 (PRIOR ART)
FIGS. 1 and 2 are cross-sectional views of two conventional electrical dust collectors.
Figure 2:
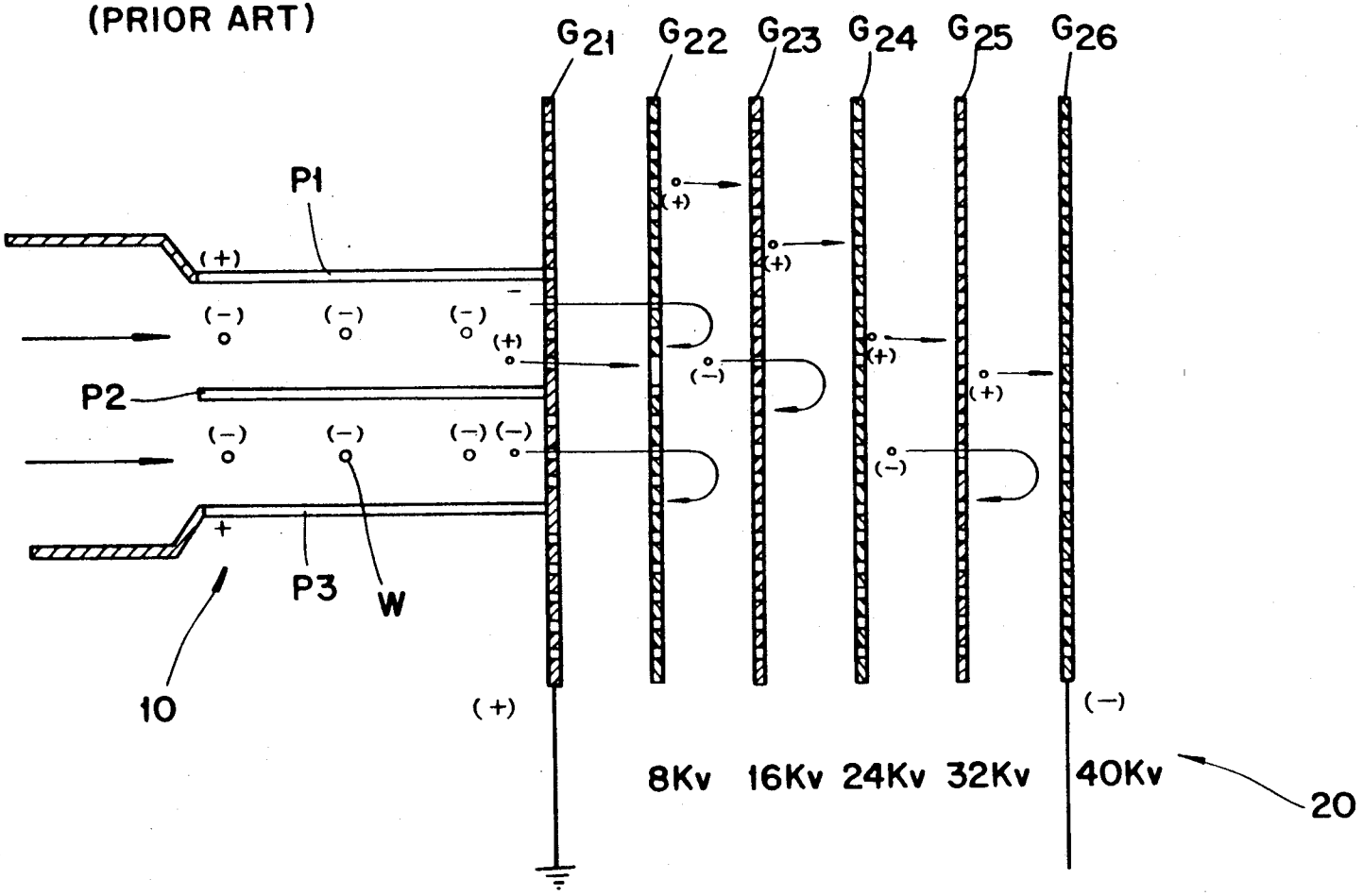
FIG. 2 (PRIOR ART)
Figure 4A:
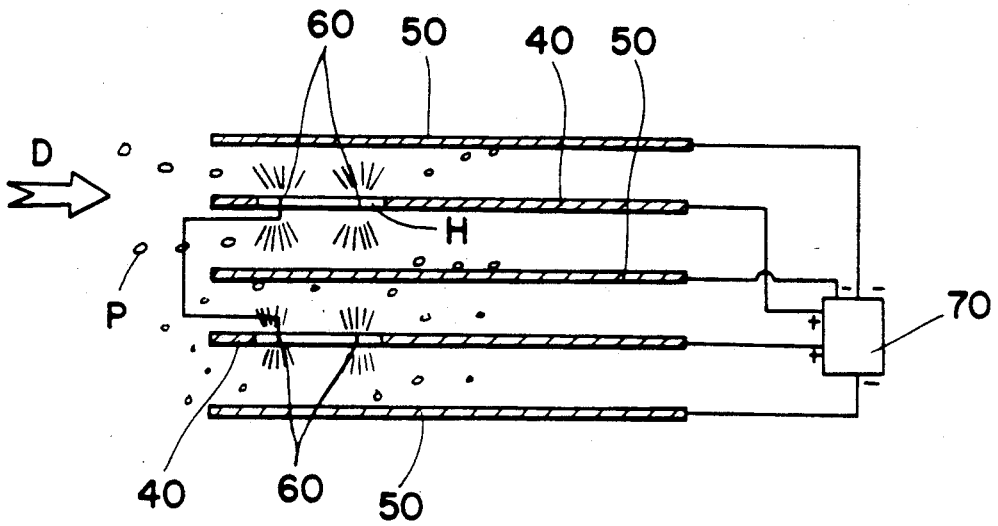
FIG. 4(*a*) is a plan view of an electrical dust collector of an air cleaner according to the present invention.
Figure 4B:
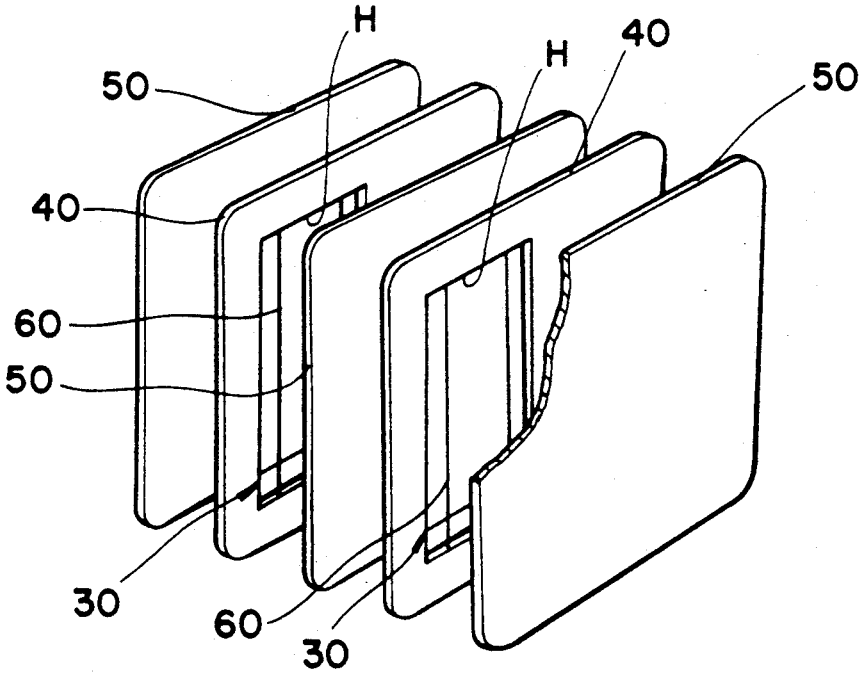

Referring to FIGS. 4 (*a*) and 4 (*b*), the dust collecting units 50 according to the present invention are in three stages, while the accelerating units 40 are in two stages and both of which can be connected and removed freely in relation to a supporting member (not shown), formed with a sliding carrier made of an insulative material. The respective ionizing units 30 are composed of a plurality of ionizing wires 60 for charging dust particles in several steps without bypass of dust particles P containing in the air D introduced and the accelerating units are supplied voltage having the same polarity as that of the power supply voltage supplied to the ionizing units 30. The ionizing units 30 and the accelerating units 40 are formed integrally.

More specifically, quadrilateral holes H are formed in a part of the surface of the accelerating units 40 and a plurality of ionizing wires 60, to which are supplied voltage having the ionizing polarity, are arranged i.e., if the air flow is horizontal, then the wires are vertical. Thus, the particles cannot easily avoid being charges as they might otherwise be able to do if the wires instead extended parallel to the air flow D, such that the particles could travel between adjacent ones of the ionizing wires 60. Thus, the invention increases the collecting efficiency in the holes perpendicular to the flowing direction D of the air.

Moreover, dust collecting units 50 are arranged in parallel to the accelerating units 40 and disposed at regular intervals from the ionizing units 30 and the accelerating units 40, respectively. The dust collecting units 50 are supplied with voltage having an opposite polarity to that in the ionizing units 30 and the accelerating units 40, so that dust particles P charged by the ionizing units 30 can be collected neatly on the inner sides of the respective dust collecting units 50 by means of the accelerating units 40.

In the electrical dust collector of the present invention constructed as described above, if d.c. voltage from the power supply unit 70 is supplied between the dust collecting units 50 and the ionizing units 30, and between the dust collecting units 50 and the accelerating units 40, then current flows through a plurality of the ionizing wires 60 and a electric field is formed uniformly between the dust collecting units 50 and the accelerating units 40, and between the dust collecting units 50 and the ionizing units 40, each being arranged at regular intervals from each other.

Accordingly, if dust particles P entrained in the air introduced in the dust collector are charged by a plurality of the ionizing wires 60 of the ionizing units 30, the charged dust particles P are accelerated toward the oppositely charged dust collecting units 50 by means of the accelerating electric field formed between the dust collecting units 50 and the accelerating units 40. At this time, the charged dust particles P are collected in a uniform thickness on the inner sides of the respective dust collecting units 50. As a result, the dust collecting efficiency is increased entirely. Of course, if the dust particles P are collected in a predetermined amount in the dust collecting units 50 as a dust collecting operation is performed over a predetermined time, the collected dust particles P must be removed from the dust collecting units 50. In this case, the accelerating units 40 and the ionizing units 30, which are integrally formed, are disconnected from the dust collecting units 50 for cleaning and are then assembled next to the dust collecting units 50.

Next, the explanation will be made, referring to FIG. 5.

Figure 5:
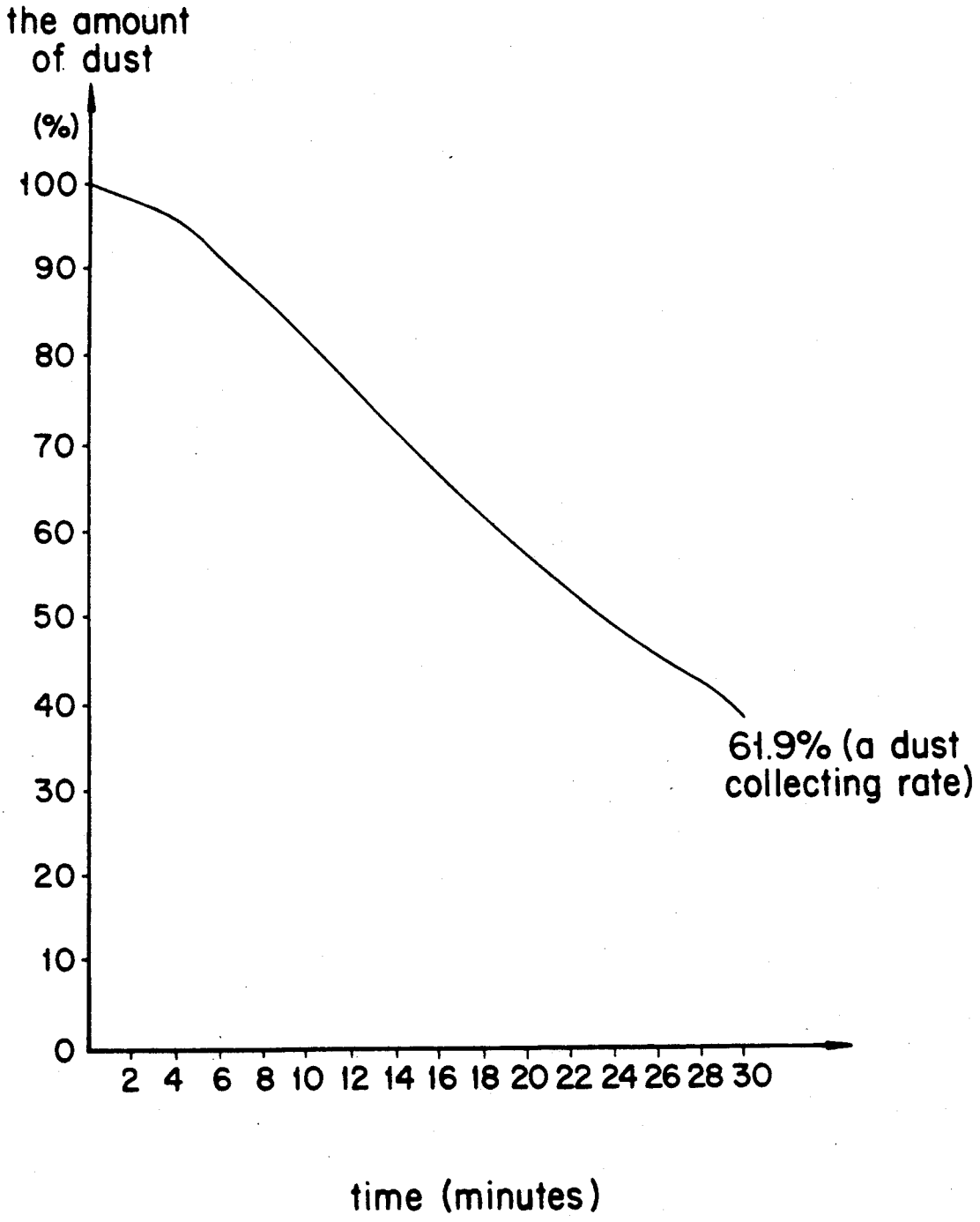
FIG. 5 is a graph illustrating a result of dust collecting performance test of a dust collector of the present invention.

In FIG. 5, a vertical axis denotes the amount of dust and a horizontal axis denotes time, in minutes. Referring to FIG. 5, an amount of dust particles to be removed from a space initially is 100 percentage. The total amount of dust collected is increased with the lapse of time. As a result, it will be known that the remaining amount of dust particles P existing in the space is decreased progressively. Here, the measured data of FIG. 5 are results measured under the condition that the direction of wind, voltage, temperature, humidity and the density of smoke are maintained constantly.

As described above, according to the electrical dust collector of the present invention, since the ionizing units and the accelerating units are formed integrally and can be connected and removed freely in relation to the dust collecting units, the ionizing wires can be prevented from damage. In addition, since the electric field is formed uniformly between the accelerating units and the dust collecting units, dust particles to be collected are distributed evenly on the dust collecting units, thereby increasing the entire dust collecting efficiency and decreasing the number of cleaning. Furthermore, since the dust collector has a high variability of voltage, the charged dust prticles may be accelerated rapidly toward the dust collecting units, thereby resulting an effect that the indoor air will be cleaned in a short time.

Obviously, the present is not limited to the specific embodiment shown and described herein. Accordingly, various modifications may be made without departing from the spirit or scope of the general inventive concept as defined by the appended claims.

What is claimed is:

1. An electrical dust collector for an air cleaner, comprising a plurality of electrically chargeable dust collecting units and a plurality of electrically chargeable accelerating units, said dust collecting units alternating with said accelerating units and being spaced therefrom to form airflow passages, each accelerating unit including a hole extending therethrough and an ionizing wire affixed integrally to said accelerating unit within said hole for generating an electric field between each ionizing wire and an adjacently disposed dust collecting unit to electrically charge dust particles entrained in an air stream passing therebetween along a respective air flow passage, said ionizing wires lying substantially within the plane of the respective accelerating unit and extending substantially parallel to the planes of said dust collecting units and non-parallel relative to the direction of air flow.

2. An electrical dust collector according to claim 1, wherein said wires and accelerating units are electrically charged with the same polarity.

3. An electrical dust collector according to claim 2, wherein said dust collecting units are electrically charged with a polarity opposite that of said wires and accelerating units.

4. An electrical dust collector according to claim 1, wherein said ionizing wires extend perpendicularly relative to the direction of air flow.

5. An electrical dust collector according to claim 1, wherein there are attached to each of said accelerating units a plurality of said wires spaced apart in the direction of air flow.

6. An electrical dust collector according to claim 1, wherein there are attached to each of said accelerating units a plurality of said ionizing wires spaced apart in the direction of air flow, each ionizing wire extending laterally relative to the direction of air flow and being of the same polarity as said accelerating units, said dust collecting units being of an opposite polarity.

7. An electrical dust collector according to claim 1, wherein said accelerating units are interconnected and removable separately relative to said dust collecting units.

* * * * *